US009254413B2

(12) United States Patent
Chen et al.

(10) Patent No.: US 9,254,413 B2
(45) Date of Patent: Feb. 9, 2016

(54) ELLIPTICAL EXERCISER

(71) Applicant: Kun Shan University, Tainan (TW)

(72) Inventors: Fu-Chen Chen, Tainan (TW); Wei-Ren Chen, Tainan (TW); Meng-Hui Hsu, Tainan (TW)

(73) Assignee: KUN SHAN UNIVERSITY, Tainan (TW)

( * ) Notice: Subject to any disclaimer, the term of this patent is extended or adjusted under 35 U.S.C. 154(b) by 144 days.

(21) Appl. No.: 14/083,853

(22) Filed: Nov. 19, 2013

(65) Prior Publication Data

US 2015/0141209 A1 May 21, 2015

(51) Int. Cl.

| | |
|---|---|
| ***A63B 22/04*** | (2006.01) |
| ***A63B 22/06*** | (2006.01) |
| ***A63B 21/018*** | (2006.01) |
| ***A63B 21/068*** | (2006.01) |
| ***A63B 22/00*** | (2006.01) |
| *A63B 21/012* | (2006.01) |
| *A63B 21/22* | (2006.01) |

(52) U.S. Cl.

CPC ..... *A63B 22/0664* (2013.01); *A63B 21/018* (2013.01); *A63B 21/068* (2013.01); *A63B 22/001* (2013.01); *A63B 22/0015* (2013.01); *A63B 21/012* (2013.01); *A63B 21/225* (2013.01); *A63B 2022/067* (2013.01)

(58) Field of Classification Search

CPC ..... A63B 22/0664; A63B 22/001; A63B 21/225; A63B 22/04; A63B 22/0015; A63B 2022/067; A63B 2022/0682; A63B 22/0056

USPC ..... 482/51–53, 57

See application file for complete search history.

(56) References Cited

U.S. PATENT DOCUMENTS

| | | | | | |
|---|---|---|---|---|---|
| 5,261,294 | A * | 11/1993 | Ticer et al. | ..... | 74/594.1 |
| 5,518,473 | A * | 5/1996 | Miller | ..... | 482/57 |
| 5,848,954 | A * | 12/1998 | Stearns et al. | ..... | 482/52 |
| 6,027,431 | A * | 2/2000 | Stearns et al. | ..... | 482/52 |
| 6,090,013 | A | 7/2000 | Eschenbach | | |
| 6,206,804 | B1 * | 3/2001 | Maresh | ..... | 482/52 |
| 6,254,514 | B1 * | 7/2001 | Maresh et al. | ..... | 482/52 |
| 6,340,340 | B1 * | 1/2002 | Stearns et al. | ..... | 482/52 |
| 6,482,130 | B1 * | 11/2002 | Pasero et al. | ..... | 482/51 |
| 7,041,034 | B1 * | 5/2006 | Stearns et al. | ..... | 482/52 |
| 7,201,706 | B1 * | 4/2007 | Lee et al. | ..... | 482/52 |
| 7,497,810 | B1 * | 3/2009 | Stearns et al. | ..... | 482/52 |
| 7,604,573 | B2 * | 10/2009 | Dalebout et al. | ..... | 482/52 |
| 2002/0094914 | A1 * | 7/2002 | Maresh et al. | ..... | 482/51 |

(Continued)

*Primary Examiner* — Loan H Thanh
*Assistant Examiner* — Andrew S Lo
(74) *Attorney, Agent, or Firm* — Muncy, Geissler, Olds & Lowe, P.C.

(57) ABSTRACT

An elliptical exerciser includes a body having two foot support links and two rotation members. The rotation members are rotated about their respective rotation pivots to drive the foot support links to move along a supporting travel and a crossing travel to complete a closed pedal trajectory. The timing adjustment wheel is pivotally connected to the body. A distance is defined between the pivot of the timing adjustment wheel and either of the rotation pivots of the rotation members. Two connecting links are pivotally connected to the timing adjustment wheel. The lengths of the two connecting links are longer than the distance. When one of the foot support links moves within the supporting travel and rotates one of the rotation members, the timing adjustment wheel drives the other foot support link to move within the crossing travel and produces speed and phase differences to be more ergonomic.

4 Claims, 7 Drawing Sheets

(56) References Cited

U.S. PATENT DOCUMENTS

| | | | | |
|---|---|---|---|---|
| 2002/0142890 | A1* | 10/2002 | Ohrt et al. | 482/52 |
| 2004/0209741 | A1* | 10/2004 | Kuo | 482/52 |
| 2006/0142123 | A1* | 6/2006 | Kettler et al. | 482/52 |
| 2007/0238582 | A1* | 10/2007 | Lee | 482/52 |
| 2008/0051259 | A1* | 2/2008 | Hsu | 482/52 |
| 2008/0167164 | A1* | 7/2008 | Wang | 482/52 |
| 2008/0269024 | A1* | 10/2008 | Lin | 482/52 |
| 2009/0048072 | A1* | 2/2009 | Chuang et al. | 482/52 |
| 2009/0111663 | A1* | 4/2009 | Kuo | 482/53 |
| 2009/0170665 | A1* | 7/2009 | Chu | 482/52 |
| 2009/0209395 | A1* | 8/2009 | Maresh et al. | 482/52 |
| 2009/0239715 | A1* | 9/2009 | Nelson et al. | 482/52 |
| 2011/0281689 | A1* | 11/2011 | Ling | 482/52 |
| 2012/0165160 | A1* | 6/2012 | Chen et al. | 482/52 |

* cited by examiner

ELLIPTICAL EXERCISER

FIELD OF THE INVENTION

The present invention relates to an elliptical exerciser, and more particularly, to an elliptical exerciser with a timing adjustment wheel so as to perform as real jogging action.

BACKGROUND OF THE INVENTION

Jogging is a popular exercise, but it is known that the jogger's knees suffer from significant impact especially at the moment that his/her foot contacts the ground. The knees are injured after suffering from the frequent impacts for a period of time. Therefore, many exercisers such as elliptical exercisers, stepper, and air walker are developed to guide the user's feet to move along a trajectory which is similar to that of real jogging, such that the user's knees are protected from being impacted and injured.

One conventional elliptical exerciser is disclosed in U.S. Pat. No. 6,090,013 entitled "CROSS TRAINER EXERCISE APPARATUS", which comprises a framework, two handles, a flywheel and two foot support members, wherein the flywheel and the handles are pivotally connected to the framework, and the foot support members are pivotally connected to two sides of the flywheel. When the handles are pivotally moved, the foot support members are guided by the flywheel and moved along a pedal trajectory which comprises a supporting travel and a crossing travel.

However, the pedal trajectory provided by the conventional elliptical exerciser is a very elliptical trajectory, so that the pedal travels on two sides of the flywheel have 180 degrees of timing delay. The timing of pedal trajectory is quite different from the one of real jogging.

Specifically, the cranks, or the flywheels, on two sides of the conventional elliptical exercisers have 180 degrees of phase difference, so that when one of the user's legs is at the front end of a pedal trajectory and going to support the user's weight, the other one is at the rear end of the pedal trajectory. As shown in FIG. 7, the supporting travel A1 and the crossing travel A2 of the pedal trajectory A have the same path length. However, in real jogging, when one of the user's legs is at the front end of the trajectory and going to support the user's weight, the other one not yet reaches the rear end of the trajectory but keeps moving backward, and does not lift to move forward until reaches the rear end of the trajectory. As shown in FIG. 8, in a trajectory B of real jogging, the path length of the supporting travel B1 is less than that of the crossing travel B2. The conventional elliptical exerciser cannot provide the user with the real jogging exercising mode and does not meet the principles of ergonomics.

When using the conventional elliptical exercisers, the user has to make his/her gait to be cooperated with the pedal trajectory provided by the conventional elliptical exerciser, so that the user cannot shift his/her weight from one leg to the other leg until his/her two legs both reach their respective extreme positions. The accumulation of the muscles sore and pain may cause sport injury to the user, and even worse if the user does not tread the pedals at a correct angle.

The present invention intends to provide an elliptical exerciser with a timing adjustment wheel so as to perform as real jogging action.

SUMMARY OF THE INVENTION

The present invention relates to an elliptical exerciser and comprises a body having two foot support links and two rotation members. The rotation members are pivotally connected to the body and each are pivotally connected to a respective one of the two foot support links. The rotation members are rotated about their respective rotation pivots to drive the foot support links to move along a supporting travel and a crossing travel to complete a closed pedal trajectory. A timing adjustment wheel is pivotally connected to the body, and a distance is defined between a pivot of the timing adjustment wheel and either of the rotation pivots of the rotation members. Two connecting links are pivotally connected to the timing adjustment wheel, and the two connecting links are longer than the distance. The two connecting links each are pivotally connected to a respective one of the rotation members. When one of the foot support links moves within the supporting travel, a respective one of the rotation members drives a respective one of the connecting links to rotate the timing adjustment wheel, and the other connecting link drives the other foot support link to move within the crossing travel.

Preferably, the timing adjustment wheel has a first side and a second side, the pivot of the timing adjustment wheel connects the first side to the second side and defines a space between the first and second sides. One of the connecting links is pivotally connected to the first side, the other one of the connecting links is pivotally connected to the second side, and the pivotal connection positions of the two connecting links are symmetrical.

Preferably, each of the two connecting links has a first pivotal portion and a second pivotal portion, each of the first pivotal portions is pivotally connected to a respective one of the rotation members. A first radius is defined between one of the first pivotal portions and a respective one of the rotation pivots of the rotation members, each of the second pivotal portions is pivotally connected to the timing adjustment wheel. A second radius is defined between one of the second pivotal portions and the pivot of the timing adjustment wheel, and each of the first and second radiuses is longer than the distance.

Preferably, the body has a resistance mechanism which comprises a resistance wheel and a transmission unit, the resistance wheel is pivotally connected to the body, and the transmission unit is connected to the resistance wheel and the timing adjustment wheel.

Preferably, the body has two arms which are pivotally connected to the body, and the arms each are pivotally connected to a respective one of the foot support links so as to move the foot support links by the arms.

The primary object of the present invention is to provide an elliptical exerciser with the distance defined between the pivot of the timing adjustment wheel and either of the rotation pivots of the rotation members. The foot support links on the two sides of the timing adjustment wheel each have different speeds when moving within the crossing travel and within the supporting travel, such that the action mode is more similar to the jogging and protects the user from being injury.

The present invention utilizes the quick-return effect which allows that before one of the foot support links is transferred from the supporting travel to the crossing travel, the other foot support link is transferred from the crossing travel to the supporting travel earlier, so that the two legs do not need to stretch to their extreme positions when the user shifts his/her weight from one leg to the other one. This prevents the user from muscle sore and pain, and the timing of the trajectory of the foot support links meet the principles of ergonomics.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
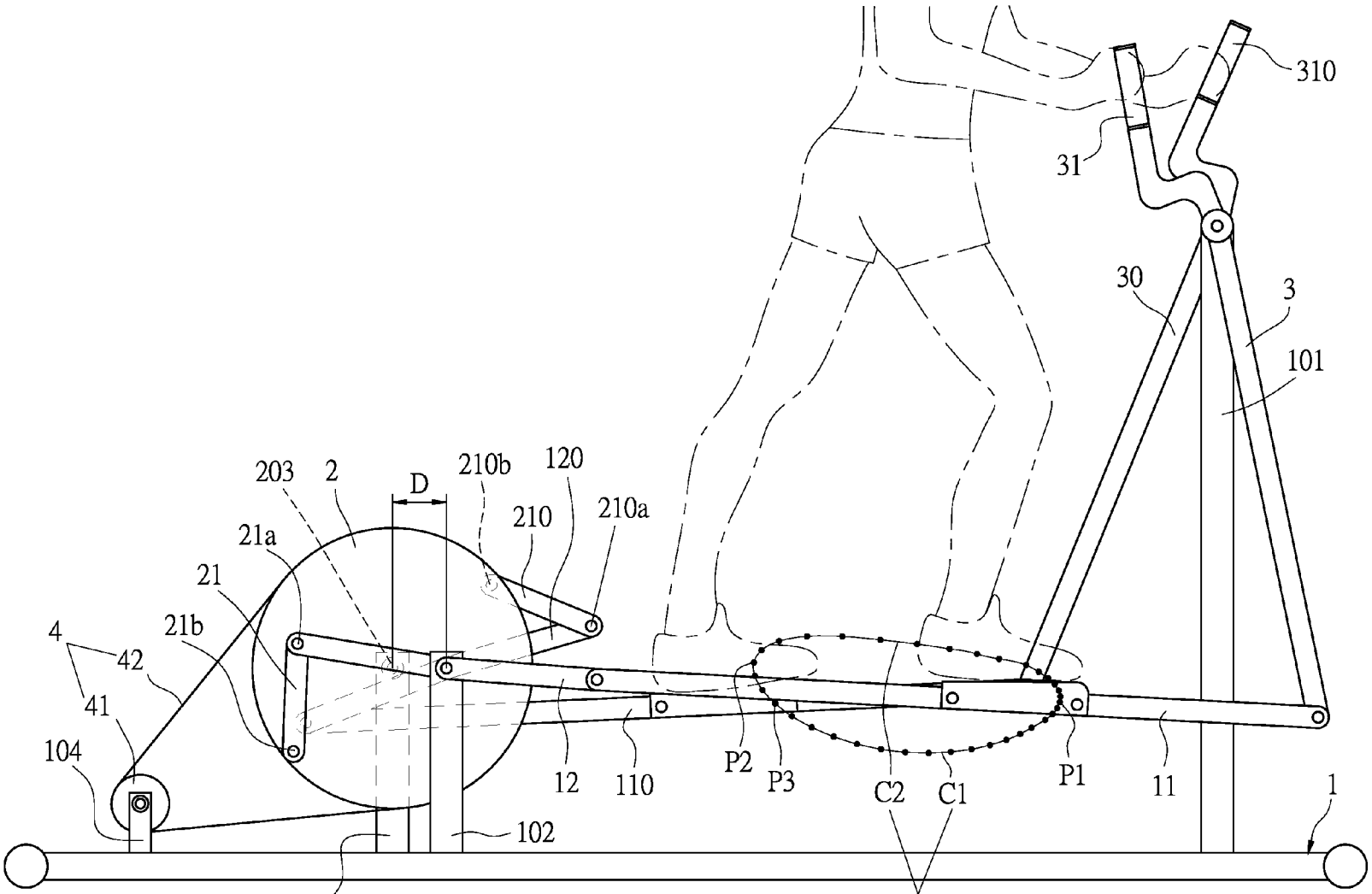
FIG. 1 is a plan view to show an elliptical exerciser in accordance with a preferred embodiment of the present invention.
Figure 2:
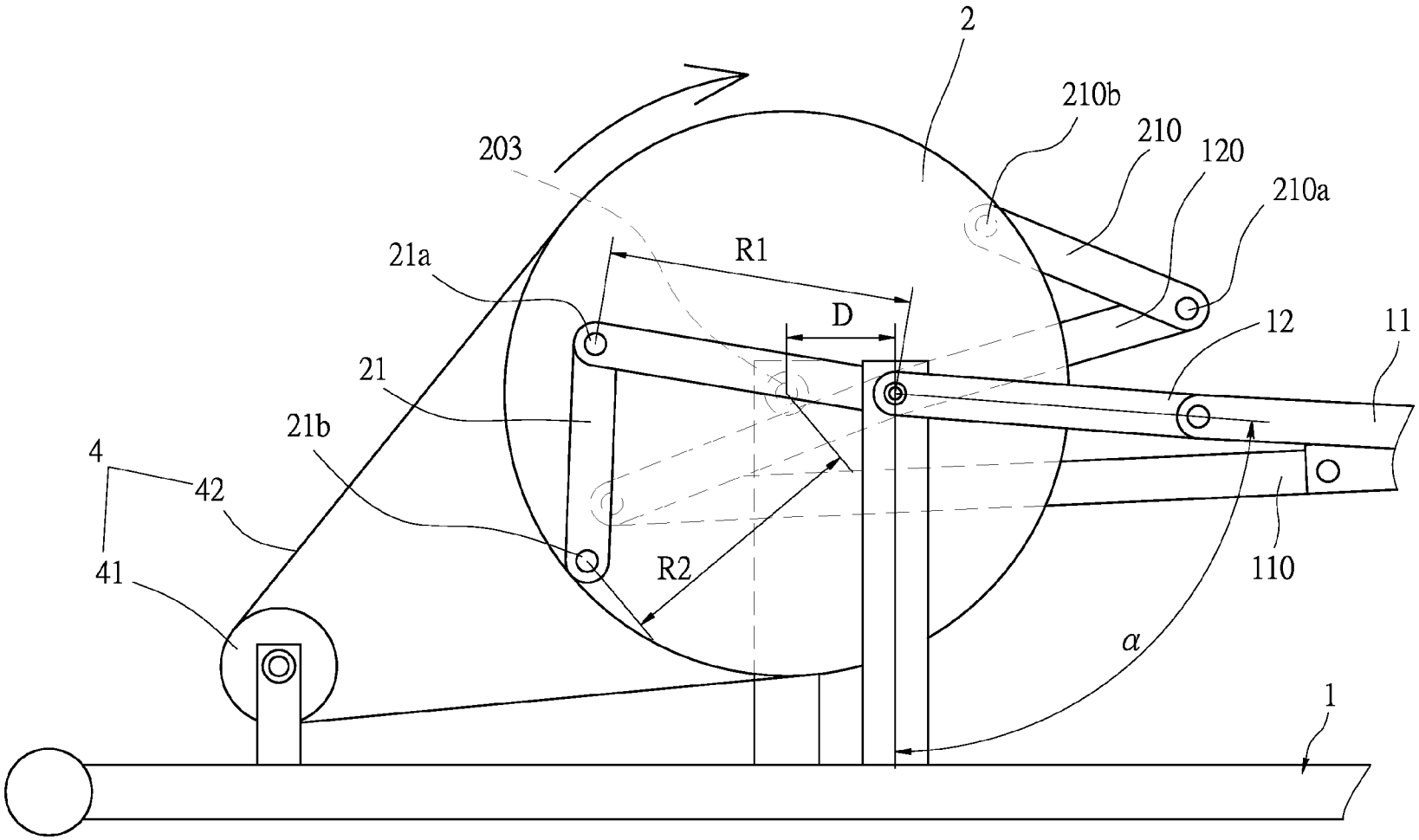
FIG. 2 is an enlarged view of a portion of the elliptical exerciser in FIG. 1.

FIGS. 1 and 2 shows lateral views of an elliptical exerciser in accordance with a preferred embodiment of the present invention. The elliptical exerciser Comprises a body 1 and a timing adjustment wheel 2. The body 1 has two foot support links 11, 110 and two rotation members 12, 120. The rotation members 12, 120 are pivotally connected to the body 1, wherein the rotation members 12, 120 are pivotally connected to the foot support links 11, 110, respectively. Therefore, when the rotation members 12, 120 are rotated about their respective rotation pivots, the foot support links 11, 110 are driven by the rotation members 12, 120, to move along a closed pedal trajectory C. The pedal trajectory C comprises a supporting travel C1 (from P1 to P3) and a crossing travel C2 (from P3 to P1).

The timing adjustment wheel 2 is pivotally connected to the body 1. A distance D is defined between the pivot 203 of the timing adjustment wheel 2 and either of the rotation pivots of the rotation members 12, 120. Two connecting links 21, 210 are pivotally connected to the timing adjustment wheel 2. Lengths of the two connecting links 21, 210 each are longer than the distance D. The connecting links 21, 210 are pivotally connected to the rotation members 12, 120, respectively. Therefore, when one of the foot support links 11 is driven to move within the supporting travel C1 (from P1 to P3), a respective one of the rotation members 12 drives a respective one of the connecting links 21 to rotate the timing adjustment wheel 2, and the rotated timing adjustment wheel 2 then drives the other connecting link 210 and the other rotation member 120 to move the other foot support link 110 to the crossing travel C2 (from P3 to P1).

Figure 3:
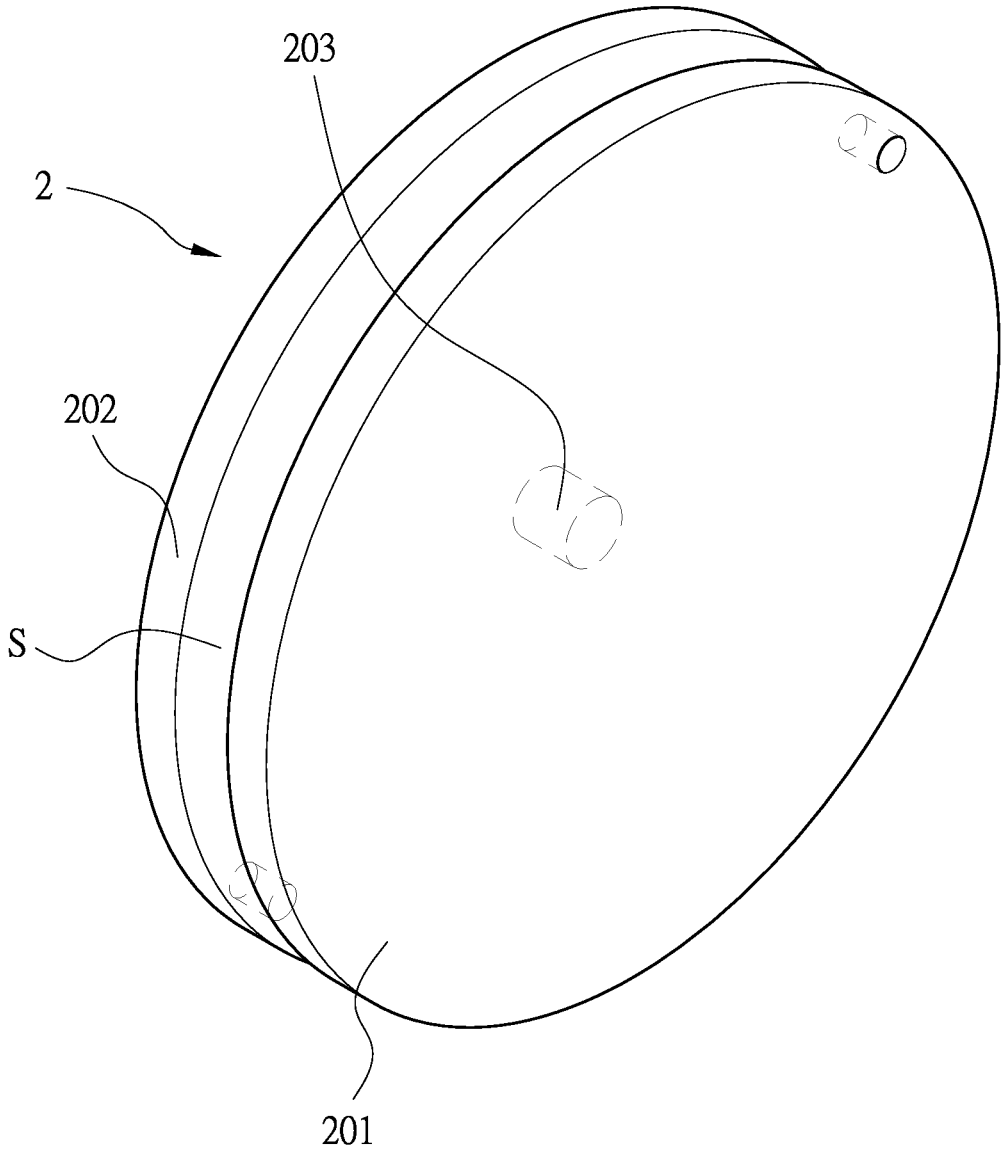
FIG. 3 is a perspective view to show the timing adjustment wheel of the elliptical exerciser in accordance with the preferred embodiment of the present invention.

Preferably, referring to FIG. 3, the timing adjustment wheel 2 has a first side 201 and a second side 202. The pivot 203 of the timing adjustment wheel connects the first side 201 with the second side 202 and defines a space S between the first and second sides 201, 202. One of the connecting links 21 is pivotally connected to the first side 201, and the other one of the connecting links 210 is pivotally connected to the second side 202. The respective pivotal connection positions of the connecting links 21, 210 are symmetrical, so that the timing adjustment wheel 2 with which the two rotation members 12, 120 cooperated is one and the same.

Preferably, the elliptical exerciser further comprises two arms 3, 30 which are pivotally connected to the body 1. The arms 3, 30 are pivotally connected to the foot support links 11, 110, respectively, so as to swing the arms 3, 30 by the foot support links 11, 110. Each of the two arms 3, 30 has a handle 31/310 for grasping by the user so that the two arms of the user can swing as in real jogging.

Preferably, the body 1 has a resistance mechanism 4 which comprises a resistance wheel 41 and a transmission unit 42. The resistance wheel 41 is pivotally connected to the body 1, and the transmission unit 42 connects the resistance wheel 41 with the timing adjustment wheel 2 to increase the rotation resistance of the timing adjustment wheel 2. The transmission unit 42 is a chain or a belt.

Specifically, in this preferred embodiment, the body 1 has a first post 101, a second post 102, a third post 103 and a fourth post 104. The two arms 3, 30 are pivotally connected to the first post 101. The two rotation members 12, 120 are pivotally connected to the second post 102. The timing adjustment wheel 2 is pivotally connected to the third post 103. The resistance wheel 41 is pivotally connected to the fourth post 104. Taken the right side of the elliptical exerciser as an example, the connecting link 21 has a first pivotal portion 21*a* and a second pivotal portion 21*b*. The first pivotal portion 21*a* is pivotally connected to the rotation member 12. The first radius R1 is defined by the distance between the first pivotal portion 21*a* and the rotation pivot of the rotation member 12. The second pivotal portion 21*b* is pivotally connected to the timing adjustment wheel 2, and the second radius R2 is defined by the distance between the second pivotal portion 21*b* and the pivot 203 of the timing adjustment wheel 2. Each of the first and second radiuses R1, R2 is longer than the distance D.

Figure 4:
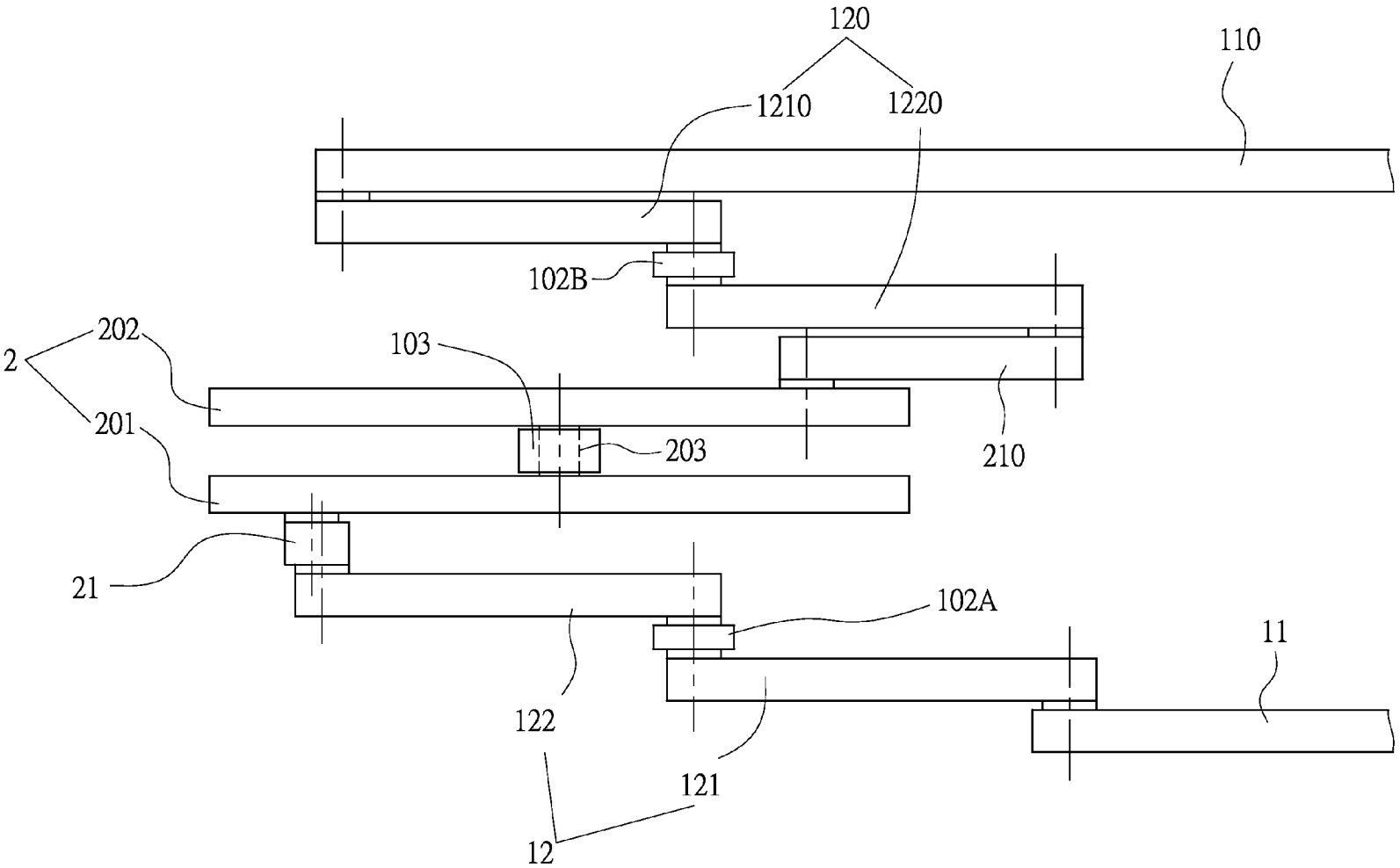
FIG. 4 is a top view of a portion of the elliptical exerciser in accordance with the preferred embodiment of the present invention.

FIG. 4 further illustrates the components arrangement of the elliptical exerciser. The two rotation members 12, 120 each have a first link 121/1210 and a second link 122/1220. The first links 121, 1210 are pivotally connected to the foot support links 11, 110, respectively. The second links 122, 1220 are pivotally connected to the connecting links 21, 210, respectively. The first link 121 and the second link 122 are joined to each other as an integral whole to transfer torques and are pivotally connected to a second post 102A; the other first link 1210 and the other second link 1220 are joined to each other as an integral whole to transfer torques and are pivotally connected to another second post 102B. For example, the first link 121/1210 and the second link 122/1220 are joined to each other by a set of key and keyway. By utilizing the components arrangement as illustrated above, the movements of the foot support links 11, 110 do not interfere with the rotations of the connecting links 21, 210. However, the anti-interference mechanism is not restricted by the above-mentioned illustration, it should be noted that other allocations derived from or varied from that are also available.

FIGS. 1 and 2 show that the user stands on the two foot support links 11, 110, wherein one of the foot support links 11 is located at a first end P1, which is the front end of the pedal trajectory C; the other one of the foot support links 110 is located at a third end P3, which is before a second end P2. The second end P2 is the rear end of the pedal trajectory C.

As the foot support link 11 is pedaled downward by the user, the foot support link 11 drives the rotation member 12 to rotate clockwise about the rotation pivot thereof, and the foot support link 11 is then guided by the rotation member 12 to move along the supporting travel C1, and the rotation member 12 drives the connecting link 21 to rotate the timing adjustment wheel 2 clockwise about the pivot 203 of the timing adjustment wheel 2. Meanwhile, the connecting link 21 is on the left side (viewing from the lateral of the elliptical exerciser, as shown in FIGS. 1 and 2) relative to the pivot 203 of the timing adjustment wheel 2 and the rotation pivot of the rotation member 12, and the rotational speed of the rotation member 12 is slower than that of the timing adjustment wheel 2. The rotated timing adjustment wheel 2 then rotates the other rotation member 120 by the other connecting link 210, such that the rotational speed of the other rotation member 120 is faster than that of the timing adjustment wheel 2. The two rotation members 12, 120 have different rotational speeds so as to accelerate the speed of the other foot support link 110 when the foot support link 110 moves within the crossing travel C2.

Figure 5:
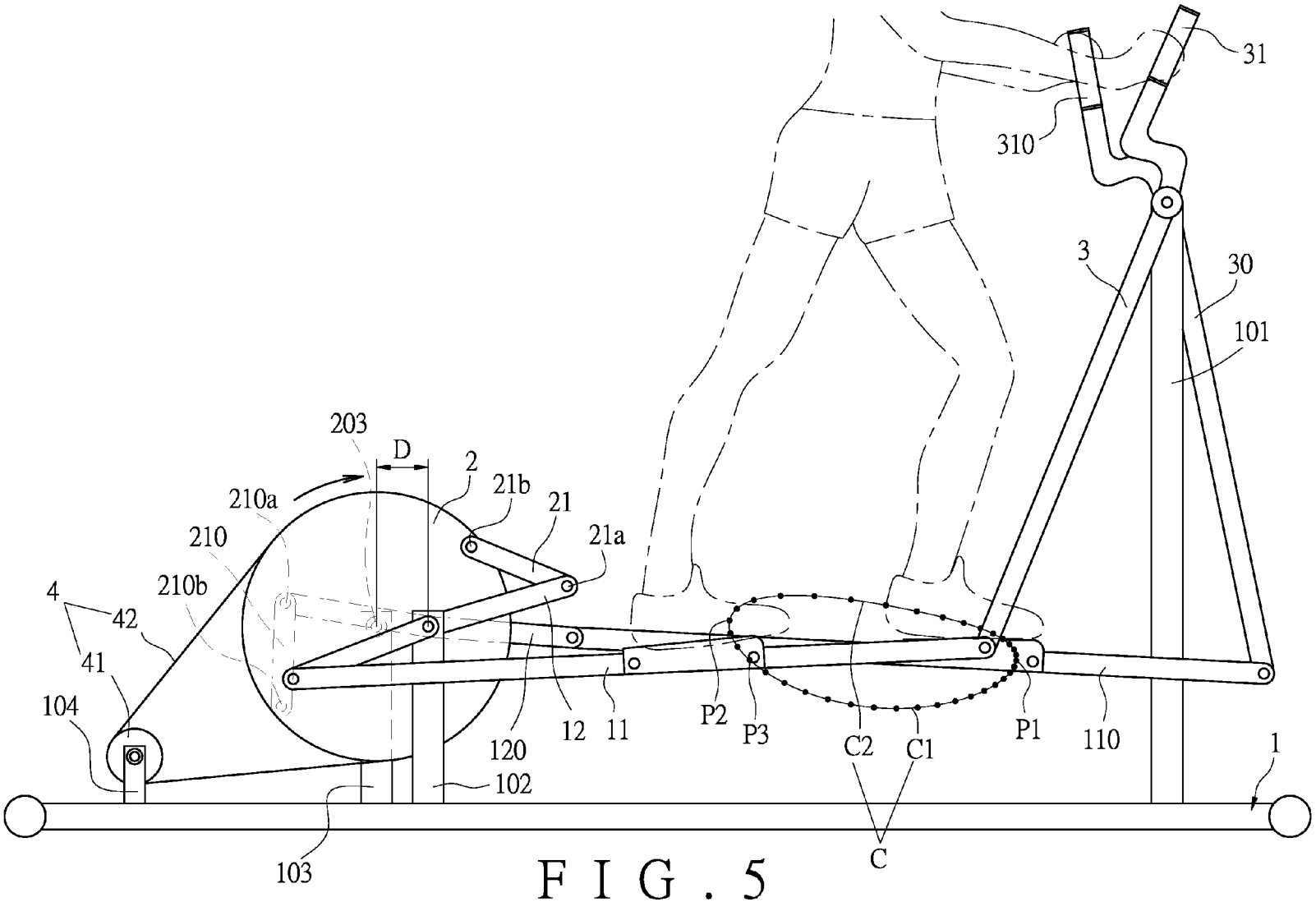
FIG. 5 shows the actions of the foot support links of the elliptical exerciser in accordance with the preferred embodiment of the present invention.
Figure 6:
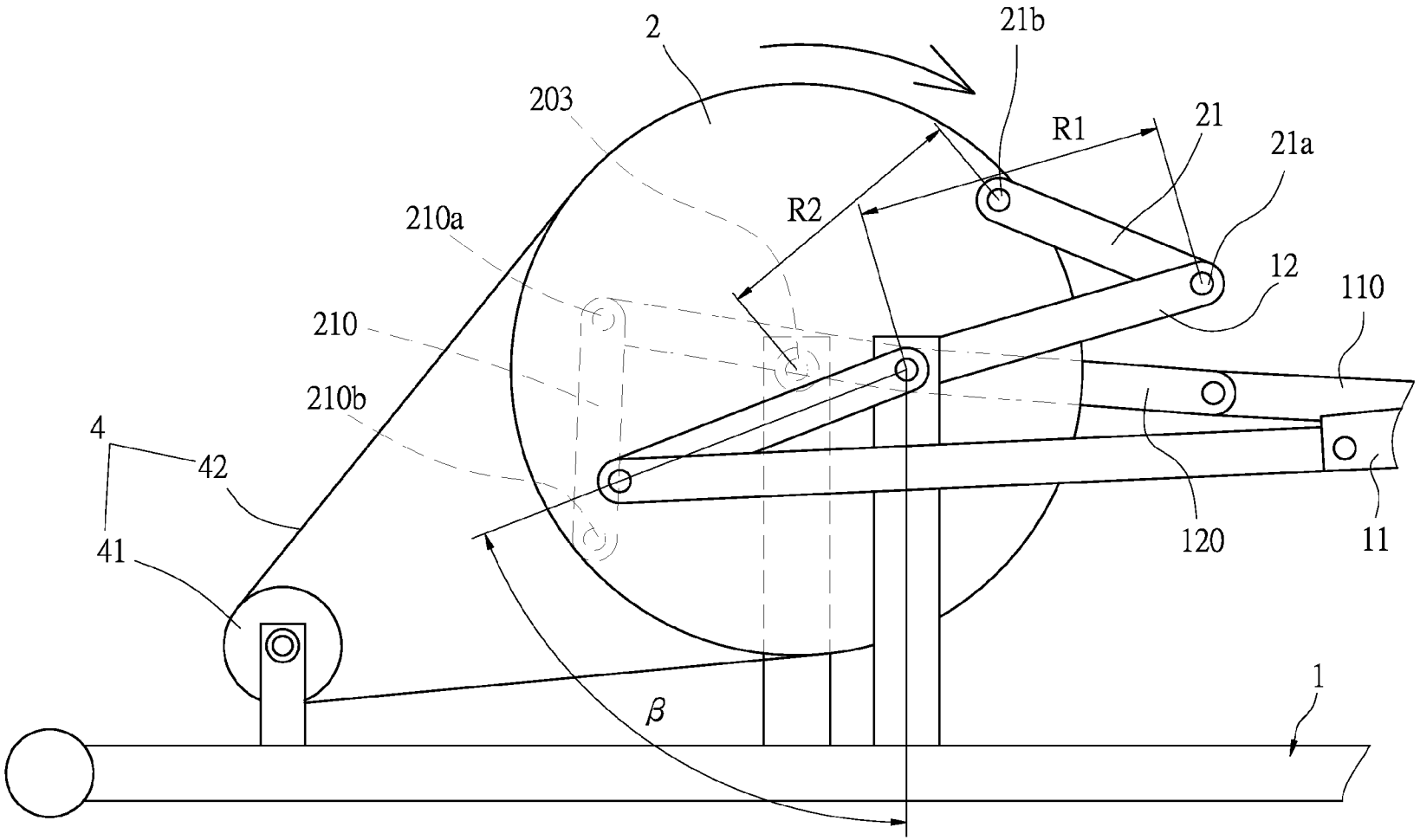
FIG. 6 is an enlarged view to show a portion of the elliptical exerciser in FIG. 5.
Figure 7:
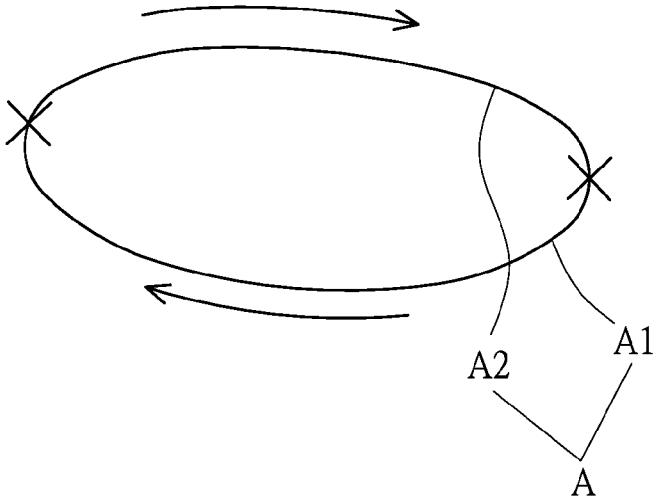
F I G . 7 (PRIOR ART)
FIG. 7 shows the pedal trajectory of a conventional elliptical exerciser.
Figure 8:
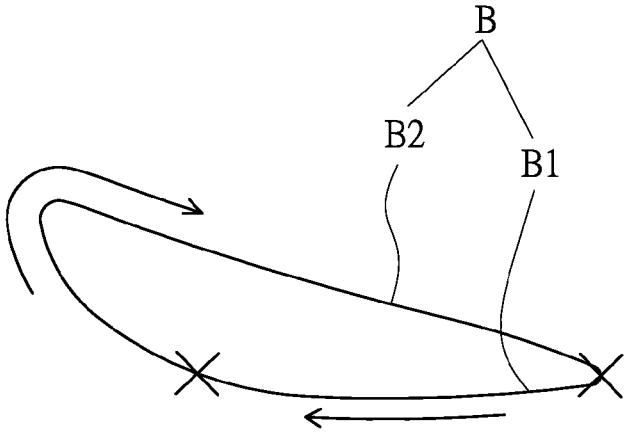
FIG. 8 shows the trajectory of real jogging.

However, referring to FIGS. 5 and 6, when the other foot support link 110 moves within the supporting travel C1, the connecting link 21 is on the right side (viewing from the lateral of the elliptical exerciser, as shown in FIGS. 5 and 6) relative to the pivot 203 of the timing adjustment wheel 2 and the rotation pivot of the rotation member 12, and the rotational speed of the rotation member 12 is faster than that of the timing adjustment wheel 2. The rotated timing adjustment wheel 2 then rotates the other rotation member 120 by the other connecting link 210, such that the rotational speed of the other rotation member 120 is slower than that of the timing adjustment wheel 2. By utilizing the quick-return effect to repeatedly switch the speeds of the two foot support links 11, 110, the two foot support links 11, 110 have different speeds and phase differences when the two foot support links 11, 110 move within the crossing travel C2 and within the supporting travel C1. This action mode is more similar to real jogging.

Referring to FIGS. 2 and 6, the quick-return effect for producing phase difference is further explained as following. When the foot support link 11 moves within the supporting travel C1, the rotational speed of the rotation member 12 is slower than that of the timing adjustment wheel 2. Therefore, when the timing adjustment wheel 2 rotates clockwise 180 degrees, the rotation member 12 has not rotated 180 degrees (i.e. the sum of the angle $\alpha$ in FIG. 2 and the angle $\beta$ in FIG. 6 is less than 180 degrees), and the foot support link 11 is at the third end P3 rather than the second end P2 of the pedal trajectory C at that time. In other words, the user does not start to move his/her right leg from the third end P3 to the second end P2 of the pedal trajectory C until his/her left leg on the other foot support link 110 reaches the front end P1 of the supporting travel C1. Therefore, the timing of the pedal trajectory C in this invention is more similar to the one of real jogging and meets the principles of ergonomics. When using the elliptical exerciser of the present invention, the user can shift his body weight from one leg to the other leg before his/her legs both stretch to their extreme positions. This action mode prevents the user from muscle sore and pain.

While we have shown and described the embodiment in accordance with the present invention, it should be clear to those skilled in the art that further embodiments may be made without departing from the scope of the present invention.

What is claimed is:

1. An elliptical exerciser comprising:

a body including:

a bottom frame;

a first post stationarily mounted to the bottom frame;

two second posts stationarily mounted to the bottom frame;

a third post stationarily mounted to the bottom frame;

two rotation members, each of the two rotation members having a first link and a second link that are joined to each other as an integral whole and being pivotally connected to a respective one of the two second posts; and two foot support links, each of the two foot support links being pivotally connected to the first link of a respective one of the two rotation members;

a timing adjustment wheel having a central area formed with a pivot rotatably connected to the third post of the body such that a constant distance is defined between the pivot of the timing adjustment wheel and a rotation pivot of either of the two rotation members; and two connecting links, each of the two connecting links having a first pivotal portion pivotally connected to the second link of a respective one of the two rotation members and a second pivotal portion pivotally connected to the timing adjustment wheel at a position adjacent to a peripheral edge of the timing adjustment wheel, wherein each of the two connecting links has a length longer than the constant distance, and wherein each of the two rotation members has a first radius defined by a distance between the rotation pivot thereof and the first pivotal portion of the connecting link connected thereto, and the timing adjustment wheel has a second radius defined by a radial distance between the pivot of the timing adjustment wheel and the second pivotal portion of either of the two connecting links, the first and second radii are longer than the constant distance.

2. The exerciser as claimed in claim 1, wherein the timing adjustment wheel has a first side and a second side between which a space is defined and which are coupled together by the pivot of the timing adjustment wheel, and the two connecting links are symmetrically respectively connected to the first side and the second side of the timing adjustment wheel.

3. The exerciser as claimed in claim 1, wherein the body has a resistance mechanism which comprises a resistance wheel and a transmission unit, the resistance wheel is pivotally connected to the body, and the transmission unit is connected to the resistance wheel and the timing adjustment wheel.

4. The exerciser as claimed in claim 1, wherein the body has two arms which are pivotally connected to the first post, and the arms each are pivotally connected to a respective one of the foot support links so as to move the foot support links by the arms.

* * * * *